US011705672B2

(12) United States Patent
Iphoefer et al.

(10) Patent No.: US 11,705,672 B2
(45) Date of Patent: Jul. 18, 2023

(54) PLUG-IN CONNECTOR WITH GROUND TERMINAL REGION

(71) Applicant: HARTING Electric Stiftung & Co. KG, Espelkamp (DE)

(72) Inventors: Maik Iphoefer, Minden (DE); Chuan Sheng Ding, Guangdong (CN)

(73) Assignee: HARTING Electric Stiftung & Co. KG, Espelkamp (DE)

( * ) Notice: Subject to any disclaimer, the term of this patent is extended or adjusted under 35 U.S.C. 154(b) by 0 days.

(21) Appl. No.: 17/939,277

(22) Filed: Sep. 7, 2022

(65) Prior Publication Data

US 2023/0006399 A1 Jan. 5, 2023

Related U.S. Application Data

(63) Continuation of application No. 17/275,614, filed as application No. PCT/CN2018/105521 on Sep. 13, 2018, now Pat. No. 11,450,989.

(51) Int. Cl.

| | |
|---|---|
| ***H01R 13/655*** | (2006.01) |
| ***H01R 13/436*** | (2006.01) |
| ***H01R 13/652*** | (2006.01) |
| ***H01R 13/6597*** | (2011.01) |

(52) U.S. Cl.

CPC ..... *H01R 13/655* (2013.01); *H01R 13/4367* (2013.01); *H01R 13/652* (2013.01); *H01R 13/6597* (2013.01)

(58) Field of Classification Search

CPC ..... H01R 13/6597

See application file for complete search history.

(56) References Cited

U.S. PATENT DOCUMENTS

| | | | | |
|---|---|---|---|---|
| 3,723,942 A | | 3/1973 | Dennison | |
| 5,151,033 A | | 9/1992 | Kawai et al. | |
| 5,181,860 A | | 1/1993 | Honma et al. | |
| 5,240,424 A | | 8/1993 | Honma et al. | |
| 5,975,955 A | * | 11/1999 | Bogiel | H01R 13/6597 439/607.56 |
| 6,000,970 A | | 12/1999 | Wu | |
| 6,004,162 A | | 12/1999 | Harting et al. | |

(Continued)

FOREIGN PATENT DOCUMENTS

| | | |
|---|---|---|
| CN | 1482713 A | 3/2004 |
| CN | 1650481 A | 8/2005 |

(Continued)

*Primary Examiner* — Ross N Gushi

(74) *Attorney, Agent, or Firm* — Smartpat PLC

(57) ABSTRACT

A heavy-duty plug-in connector has a ground terminal that can be conveniently assembled and can comprise the greatest possible number of electrical crimp plug-in contacts (4,5). For this purpose, ground plug-in contacts (4', 5'), likewise of a crimping configuration, are fitted in formations (13, 13', 23, 23') of the contact carriers (1, 2) for electrical contacting with metallic protective earthing elements (3, 3', 3'', 3'''). For said contacting, the formations (13, 13', 23, 23') have a respective opening (130, 130') or passage (230, 230'). In the formations (13, 13', 23, 23'), not only ground plug-in contacts (4', 5') but also further plug-in contacts (4, 5) are arranged, so that the number of plug-in contacts (4, 5) of the plug-in connector is increased considerably.

12 Claims, 8 Drawing Sheets

(56) References Cited

U.S. PATENT DOCUMENTS

| | | | |
|---|---|---|---|
| 6,254,403 | B1 | 7/2001 | Bernardini |
| 6,527,583 | B2 | 3/2003 | Plate |
| 10,148,030 | B2 | 12/2018 | Krech |
| 2003/0232527 | A1 | 12/2003 | Shuey |
| 2004/0038596 | A1 | 2/2004 | Bartholoma et al. |
| 2004/0053528 | A1 | 3/2004 | Kainz et al. |
| 2005/0239305 | A1 | 10/2005 | Akino |
| 2006/0028316 | A1 | 2/2006 | Fabian et al. |
| 2010/0062629 | A1 | 3/2010 | Feldman et al. |
| 2010/0119387 | A1 | 5/2010 | Malec et al. |
| 2014/0179172 | A1 | 6/2014 | Riepe et al. |
| 2014/0199870 | A1 | 7/2014 | Tamaki et al. |
| 2015/0280410 | A1 | 10/2015 | Elberbaum |
| 2015/0325956 | A1 | 11/2015 | Schreier et al. |
| 2016/0072231 | A1 | 3/2016 | Sypolt et al. |
| 2016/0336677 | A1 | 11/2016 | Herbrechtsmeier |
| 2017/0005445 | A1 | 1/2017 | Resendez et al. |
| 2018/0257683 | A1 | 9/2018 | Govindappa et al. |
| 2020/0117789 | A1 | 4/2020 | Funk et al. |
| 2020/0127423 | A1 | 4/2020 | Edenhofer et al. |

FOREIGN PATENT DOCUMENTS

| | | | |
|---|---|---|---|
| CN | 102197469 | A | 9/2011 |
| CN | 105449464 | A | 3/2016 |
| CN | 105531875 | A | 4/2016 |
| CN | 206712157 | U | 12/2017 |
| CN | 106716741 | B | 11/2019 |
| DE | 3912189 | C2 | 5/1992 |
| DE | 9207738 | U1 | 8/1992 |
| DE | 9310953 | U1 | 8/1994 |
| DE | 19715156 | C1 | 8/1998 |
| DE | 202007017892 | U1 | 3/2008 |
| DE | 102006050818 | A1 | 4/2008 |
| DE | 102013108383 | A1 | 2/2015 |
| DE | 102013016550 | A1 | 4/2015 |
| DE | 102014119220 | A1 | 6/2016 |
| DE | 102014100142 | | 2/2018 |
| DE | 102017113875 | | 10/2018 |
| EP | 0475414 | B1 | 5/1995 |
| EP | 0860906 | A3 | 3/2000 |
| EP | 1275173 | A1 | 1/2003 |
| EP | 1353414 | A3 | 8/2005 |
| EP | 2862237 | A1 | 4/2015 |
| EP | 2746129 | B1 | 2/2016 |
| EP | 3104469 | A1 | 12/2016 |
| EP | 3312940 | A1 | 4/2018 |
| JP | 2008243566 | A | 10/2008 |
| WO | 2007044189 | A2 | 4/2007 |
| WO | 2011069522 | A1 | 6/2011 |
| WO | 2016037607 | A1 | 3/2016 |
| WO | 2018192962 | A1 | 10/2018 |

* cited by examiner

PLUG-IN CONNECTOR WITH GROUND TERMINAL REGION

TECHNICAL FIELD

The disclosure relates to a plug-in connector, to a contact arrangement for a plug-in connector, and to a protective earthing element for a plug-in connector.

BACKGROUND

Plug-in connectors are required in order to use a multiplicity of plug-in contacts, i.e. pin and/or socket contacts, for transmitting possibly even electrical signals, but also current of high current intensities, for example current of more than 1 A ("ampere"), in particular of more than 2 A, preferably of more than 4 A, particularly preferably of more than 6 A, that is to say for example of up to 10 A and in some cases even 10 A and more, per contact in a connectable and disconnectable manner. On account of these high current intensities, such plug-in connectors are referred to as heavy-duty plug-in connectors. They usually have an at least partially metallic plug-in connector housing, which is earthed in the prescribed manner for example by a ground terminal region of the plug-in connector.

Plug-in connectors with ground terminals are generally known in the prior art.

They are usually provided with earthing screws, which are for example arranged on earthing elements of their contact carriers or else on modular holding frames. Such a PE ("protection earth"/protective earth) contact is shown for example in the document EP 0 860 906 B1.

Recently, there have been efforts to make this connection technique more convenient. Thus, for example, the document WO 2011/069522 A1 describes a plug-in connector with an integrated modular system that has a PE connection by means of a crimp terminal.

The document DE 10 2013 108 383 A1 discloses a plug-in connector module for a plug-in connector modular system which on the one hand may comprise a terminal for crimp contacts and on the other hand provides an earthing clamp for electrically contacting the modular holding frame. If required, this also allows grounding cross sections of already existing connections to ground to be additionally increased.

A disadvantage of this prior art is that, although the aforementioned type of protective earthing can be conveniently operated, it also has a considerable space requirement. However, in principle the installation space for an industrial plug-in connector is limited. For many applications, the number of plug-in contacts and their current-carrying capacity, in particular with respect to air gaps and creepage paths, is a decisive criterion.

SUMMARY

An object of the disclosure is to provide a plug-in connector, in particular a heavy-duty plug-in connector, that has a ground terminal which can be conveniently assembled and allows the arrangement of the greatest possible number of electrical plug-in contacts in a given installation space.

This object is achieved by the features of the independent claims.

A plug-in connector comprises a plug and a mating plug.

The plug has a pin contact carrier and a number of pin contacts that are received or are to be received therein. The pin contacts have in each case a terminal region and a contact pin. The pin contact carrier comprises a holding portion and a plugging portion with a peripheral collar.

The terminal region of the pin contacts is received in continuous pin contact receptacles of the holding portion and fixed therein, or at least can be received and fixed therein. As a result, the pin contacts in the received state are held stably in the pin contact carrier and protrude with their exposed contact pins into the plugging portion thereof.

The mating plug has a socket contact carrier and a number of socket contacts that are received or are to be received therein. The socket contacts have in each case a terminal region and a contact socket. The socket contact carrier has a terminal portion and a mating plugging portion.

The socket contact carrier has continuous socket contact receptacles for completely or at least partially receiving the socket contacts. In this case, the socket contact receptacles run both through the terminal portion and through the mating plugging portion of the socket contact carrier. In the received state, the socket contacts are arranged with their terminal region in the terminal portion and with their contact sockets in the mating plugging portion of the socket contact carrier and are held therein.

The pin contact carrier and the socket contact carrier can be plugged together. In the plugged state, the peripheral collar of the pin contact carrier encloses the mating plugging portion of the socket contact carrier. At the same time, the pin contacts received in the pin contact carrier are connected in an electrically conducting manner to the socket contacts received in the socket contact carrier, in that a respective contact pin is completely or at least partially received by a respective contact socket.

The plug-in connector also has at least one ground terminal region. This ground terminal region includes a pin contact carrier formation and a socket contact carrier formation. In the plugged state, the pin contact carrier formation and the socket contact carrier formation engage in one another or butt against one another or are at least arranged adjacently.

The plug-in connector also comprises a first protective earthing element, which is fastened, or at least can be fastened, on an outer region of the pin contact carrier formation.

A number of pin contacts are received or can be received in the pin contact carrier formation. One of these pin contacts is a ground pin contact. That pin contact receptacle in which the terminal region of the ground pin contact is received or is to be received is a ground pin contact receptacle and is distinguished by an opening through to the outer region of the pin contact carrier formation. Through this opening, the received ground pin contact is connected in an electrically conducting manner to the first protective earthing element.

The plug-in connector also comprises a second protective earthing element, which is fastened or can be fastened on an outer region of the socket contact carrier formation.

A number of socket contacts are received or are to be received in the socket contact carrier formation. One of these socket contacts is a ground socket contact. That socket contact receptacle in which the ground socket contact is received or is to be received is a ground socket contact receptacle and is distinguished by a passage through to the outer region of the socket contact carrier formation. Through this passage, the received ground socket contact in the inserted state is connected in an electrically conducting manner to the second protective earthing element.

The term "plug-in contacts" should be understood here and hereinafter as meaning pin and socket contacts that can be plugged together and as a result can be electrically connected to one another, a pin contact and a socket contact that can be plugged together with it respectively forming a "contact pair".

The term "ground plug-in contacts" should be understood as meaning those plug-in contacts which do not serve functionally for electrical current and/or signal transmission but just for connecting to ground, and accordingly are also referred to individually as "ground pin contacts" and "ground socket contacts".

A ground pin contact and a ground socket contact that can be plugged with it form a "ground contact pair".

The term "contact carrier" is an umbrella term for the pin contact carrier and the socket contact carrier.

The term "plug-in contact receptacles" is an umbrella term for the pin and socket contact receptacles of the pin and socket contact carriers, which for their part are grouped together under the umbrella term "contact carriers".

Accordingly, the pin contact carrier formation and the socket contact carrier formation are grouped together under the umbrella term "contact carrier formations".

Advantageous designs of the invention are specified in the dependent claims.

The pin and socket contacts may in each case be configured in one piece and formed from metal, for example in the form of a metallic turned part that is in particular coated with an electrical contact material. The contact carriers, i.e. the pin contact carrier and the socket contact carrier, are preferably insulators, which are produced from an electrically insulating material, for example plastic, for example by an injection-molding process. The protective earthing elements consist of an electrically conductive material, for example metal, in particular of sheet metal, for example of spring steel. The protective earthing elements are preferably stamped and bent parts.

As mentioned at the beginning, the plug-in connector may have an at least partially metallic plug-in connector housing. The plug-in connector housing may comprise a plug housing and a mating plug housing, the plug housing being a component part of the plug and the mating plug housing being a component part of the mating plug. Then, the pin contact carrier can be fastened, in particular can be screwed, in or on the plug housing by means of the first protective earthing element and preferably also by means of the third protective earthing element. The socket contact carrier can be fastened, in particular can be screwed, in or on the mating plug housing by means of the second protective earthing element and preferably also by means of the fourth protective earthing element. Consequently, a connection to ground at least on one side of the plug-in connector housing can also be established by the ground terminal region.

The invention is advantageous because in this way a particularly great number of plug-in contacts, that is to say pin and socket contacts, can be arranged in the limited installation space of the plug-in connector, in particular within the socket contact carrier or the pin contact carrier. Finally, the ground terminal region may also serve additionally for receiving those plug-in contacts that are intended for electrical current and/or signal transmission, which are therefore not ground plug-in contacts. As a result, additional installation space is used for electrical current and/or signal transmission. The resultant particularly high number of plug-in contacts also allows overall a comparatively high current to be transmitted in the limited installation space, which represents an additional advantage in the area of electrical energy transmission.

The plug-in contacts are usually plugged into the plug-in contact receptacles, i.e. into the pin and socket contact receptacles, of the respective contact carrier, and held therein, for example by a locking engagement, with an electrical line respectively connected thereto, which may in particular be a component part of a cable comprising a number of electrical lines.

Consequently, during the assembly of the plug-in connector, the pin and socket contacts, each provided with an electrical line of a cable, can be inserted on the cable connection side into the pin contact receptacles of the pin contact carrier or into the socket contact receptacles of the socket contact carrier and fixed therein.

In particular, the ground plug-in contacts, i.e. the ground pin contacts and the ground socket contacts, can be connected in the same way to an earthing line, i.e. an electrical PE ("protective earth") line, which may likewise be a component part of said cable.

The ground plug-in contacts can then be plugged into their respective ground plug-in contact receptacle and fixed therein. This means that work during assembly is greatly facilitated, because there is no need to perform a separate step for the protective earthing connection.

This makes the assembly of the ground plug-in contacts very convenient in comparison with a conventional, PE ("protective earth") screw contact. For example, a PE line of the cable to be connected needs to be provided with a ground plug-in contact in the same way as any other electrical line of the same cable needs to be provided with any other plug-in contact of the plug-in connector. The respective ground plug-in contact may then be plugged on the cable connection side into the respective ground plug-in contact receptacle of the respective contact carrier, in order to allow the desired ground connection both on the plugging side and by way of the protective earthing element on the plug-in connector housing side.

In a preferred design, the plug-in contacts may be crimp contacts, i.e. the terminal region of the pin contacts and the terminal region of the socket contacts is configured in each case as a crimp terminal. Then, for example a line core of the respective line can be connected to the respective crimp terminal by plastic deformation thereof, for example by means of a crimping tool and/or a crimping machine. For example, the crimp terminal of the respective plug-in contact may be configured as hollow, for example in the form of a hollow cylinder, that is to say comprises a cavity. The line core of the corresponding electrical line, which may for example also be said PE line, is inserted into the cavity for the crimping. Then, the crimp terminal can be pressed together, for example by using the crimping tool and/or the crimping machine, so that the line core is pinched in the crimp terminal of the respective plug-in contact in an electrically conducting manner and at least in a force-fitting manner, and in particular also at least partially in a form-fitting manner.

In a preferred design, when plugging the plug with the mating plug, the ground pin contact may lead the other contact pins of the plug. This can be realized for example by the design of the ground pin contact receptacle in the pin contact carrier formation. For this purpose, a locking mechanism of the ground pin contact receptacle that is intended for fixing the ground pin contact may for example be arranged somewhat further down in the holding portion than is the case with the other pin contact receptacles. Consequently, for its fixing in the pin contact carrier, the ground pin contact can be inserted deeper into the holding portion of the pin contact carrier than the other pin contacts, and as a result its contact pin protrudes further into the plugging portion than the contact pin of the other pin contacts. This is advantageous because a ground terminal that leads during plugging, which is required for safety reasons, is made possible in this way, without a separate, in particular longer, ground pin contact having to be used for this. Therefore, it is not necessary to use pin contacts of different lengths for this, that is to say for example pin contacts with contact pins of different lengths, but instead the same pin contacts as for the electrical current and signal transmission are used for connecting to ground. As a result, only one type of pin contacts is used for the entire plug-in connector, which simplifies the structural design of the plug-in connector considerably.

The ground pin contact can consequently be structurally identical to the other pin contacts and the ground socket contact can furthermore also be structurally identical to the other socket contacts. Then the ground plug-in contacts only differ from the other plug-in contacts by their function and possibly by their arrangement in the respective contact carrier.

This function of the ground plug-in contacts is, among other things, that a PE line is respectively connected to the ground plug-in contacts, for example is crimped on. The ground plug-in contacts are then plugged furthermore into the ground plug-in contact receptacles especially provided for this, i.e. into the ground pin contact receptacles of the pin contact carrier or into the ground socket contact receptacles of the socket contact carrier. These ground plug-in contact receptacles that are especially provided for this purpose differ from the other plug-in contact receptacles or socket contact receptacles by said opening or passage through to the outer side of the ground terminal region. Finally, through this opening or through this passage, the ground plug-in contacts are brought into electrical contact with the respective protective earthing element, for example for the ground plug-in contacting of the plug-in connector housing, and in this way can for example earth the plug-in connector housing.

In the plugged state, the contact pin of the at least one ground pin contact can be plugged with the contact socket of the at least one ground socket contact, i.e. in the plugged state it is at least partially received by it and is thus in engagement with it, whereby the ground pin contact and the ground socket contact are connected to one another in an electrically conducting manner. This is particularly advantageous because the ground potentials of the plug and the mating plug are thus connected to one another particularly reliably and with particularly good conducting characteristics. The ground pin contact and the ground socket contact then form a ground contact pair, and consequently establish a particularly reliable and low-impedance ground connection between the plug and the mating plug, in particular also on the plugging side.

The pin contact carrier formation may be of a substantially cuboidal configuration, that is to say for example have a rectangular cross section, in which for example the corners are rounded. The pin contact carrier may also comprise a basic form which consists of a basic cuboid onto which the cuboidal pin contact carrier formation is formed. The pin contact carrier formation may in this case be significantly smaller than the basic cuboid, i.e. its volume may for example be respectively less than a quarter of the volume of the basic cuboid.

The socket contact carrier formation may also be of a substantially cuboidal configuration, and may in particular correspond to the pin contact carrier formation, that is to say in particular have a comparable cross section. The socket contact carrier formation may in the plugged state be arranged on the plugging side adjacent to the pin contact carrier formation, and may in particular adjoin it. In a preferred design, the socket contact carrier formation may in the plugged state be enclosed on at least three sides by the collar of the pin contact carrier in the region of its pin contact carrier formation, in particular in a force-fitting manner, i.e. the pin contact carrier formation and the socket contact carrier formation may engage in one another, in particular in a form-fitting manner, in the plugged state.

In a preferred design, the pin contact carrier may comprise in addition to said, preferably substantially cuboidal, pin contact carrier formation also a further, preferably substantially cuboidal, pin contact carrier formation, so that it comprises altogether two, preferably substantially cuboidal, pin contact carrier formations. These two pin contact carrier formations may be formed on two side faces of the basic cuboid lying opposite one another, in particular lying symmetrically opposite one another, and together with this basic cuboid form the basic form of the pin contact carrier.

In a preferred design, the socket contact carrier may also comprise in addition to said, preferably substantially cuboidal, socket contact carrier formation also a further, preferably substantially cuboidal, socket contact carrier formation, so that it comprises altogether two, preferably substantially cuboidal, socket contact carrier formations, which are formed on two side faces of a basic cuboid lying opposite one another, in particular lying symmetrically opposite one another, and together with this basic cuboid form the basic form of the socket contact carrier.

In a preferred design, the plug-in connector may have in addition to said ground terminal region a further ground terminal region, the further ground terminal region comprising the further contact carrier formations, i.e. the further pin contact carrier formation and the further socket contact carrier formation.

Then a further ground pin contact may be arranged in the further pin contact carrier formation and a further ground socket contact may be arranged in the further socket contact carrier formation, the further ground pin contact and the further ground socket contact forming a further ground contact pair.

For this purpose, the further pin contact carrier formation may comprise a further ground pin contact receptacle with a further opening and the further socket contact carrier formation may comprise a further ground socket contact receptacle with a further passage. As a result, the further ground pin contact and the further ground socket contact can be connected in an electrically conducting manner to a third and a fourth protective earthing element respectively, and thus contribute to said connection to ground to the plug-in connector housing.

Finally, in an advantageous design, a connection to ground on both sides of the at least partially metallic plug-in connector housing, and as a result also a particularly homogeneous connection to ground, can be achieved by the further ground terminal region. Such a, particularly homogeneous, connection to ground provides particularly effective shielding, in particular in the high frequency range. Furthermore, the plug-in connector can have as a result altogether a particularly large grounding cross section, for example twice as large as with only one ground terminal region. Such a particularly large grounding cross section may therefore be of use for example when designing for the transmission of particularly high current intensities.

These two ground terminal regions of the plug-in connector may then be configured structurally identically or at least symmetrically in relation to one another and may be opposite one another, in particular symmetrically, on the contact carriers. The further ground terminal region may comprise two further protective earthing elements, specifically a third and a fourth protective earthing element, of which the third protective earthing element is arranged on the outer region of the further pin contact carrier formation and the fourth protective earthing element is arranged on the outer region of the further socket contact carrier formation.

In another, particularly preferred design, the further pin contact carrier formation may however also be a purely additional pin contact carrier region, which serves exclusively for electrical energy and/or signal transmission and consequently not for connecting to ground. The further pin contact carrier formation is in this case therefore not intended to receive a further ground pin contact. Consequently, therefore, no further ground pin contact receptacle is required in the further pin contact carrier formation either, i.e. no further opening is necessary in the pin contact carrier formation either. This is particularly advantageous because, by dispensing with a further ground pin contact, all the more other pin contacts can be received in the additional pin contact carrier region.

Then, the third protective earthing element may nevertheless be attached to the further pin contact carrier formation for fastening in or on the plug housing, although no protective earthing at all is necessary at this point. Finally, in this way furthermore the fastening function of the protective earthing element can be used.

Accordingly, the further socket contact carrier formation may also be a purely additional socket contact carrier region, which serves exclusively for electrical energy and/or signal transmission and consequently not for connecting to ground. The further socket contact carrier formation is in this case therefore not intended to receive a further ground socket contact. Therefore, no further ground socket contact receptacle is required in the further socket contact carrier formation either, i.e. no further passage is necessary in the pin contact carrier formation either. It is particularly advantageous here that, by dispensing with a further ground socket contact, all the more other socket contacts can be received in the additional socket contact carrier region.

Furthermore, the further socket carrier formation may comprise the fourth protective earthing element for fastening in or on the mating plug housing, although no protective earthing at all is necessary at this point. Finally, in this way at least the fastening function of the protective earthing element can be used.

Consequently, the plug-in connector may also in this structural form comprise altogether four protective earthing elements, two of which, specifically the first and third protective earthing elements, are arranged on the two pin contact carrier formations and the other two, specifically the second and fourth protective earthing elements, are arranged on the two socket contact carrier formations. In this case, the protective earthing elements may be identically configured, even if the third and fourth protective earthing elements have only a fastening function, while the first and second protective earthing elements have both a fastening function and an electrically conducting function, specifically said function of connecting to ground the ground plug-in contacts to the plug-in connector housing.

This structural form is therefore appropriate if on the one hand the grounding cross section of a single PE line and a single ground contact pair is regarded as adequate, but on the other hand the highest possible number of plug-in contacts is required. The plug-in connector then has instead of the further ground terminal region an additional plug-in contact carrier region, which comprises the additional pin contact carrier region and the additional socket contact carrier region. This plug-in contact carrier region therefore has been or is provided exclusively with plug-in contacts that are not intended as ground plug-in contacts. As a result, the number of plug-in contacts that are arranged or are to be arranged therein and are intended for electrical energy and signal transmission can be increased once again, depending on the structural form, for example by one or two plug-in contacts. Altogether, one ground contact pair and four further contact pairs may then be arranged for example in the ground terminal region and six further contact pairs may be arranged in the additional plug-in contact region.

The use of the third and fourth protective earthing elements on the plug-in contact carrier region for the mechanical fastening thereof on the plug-in connector housing has the advantage of particularly economical production, because no separate holding element has to be designed and produced. Furthermore, a symmetrical appearance of the plug-in connector is ensured as a result, even if it only comprises a single ground terminal region.

Those pin contacts that are located in said basic cuboid of the pin contact carrier, that is to say are arranged outside the pin contact carrier formation, may be arranged offset in relation to one another, in order to arrange the greatest possible number of plug-in contacts in the given installation space. Those socket contacts that are located in the basic cuboid, that is to say are arranged outside the socket contact carrier formation, are then of course arranged in the same form, specifically offset in relation to one another, in order to form a contact pair respectively with the pin contacts. The term " . . . arranged offset in relation to one another . . . " means in this case that the center points of these adjacent plug-in contacts form an isosceles triangle. This of course means here and hereinafter also that the associated plug-in contact receptacles in the respective contact carrier are arranged offset in relation to one another in the same way as the plug-in contacts. Consequently, the plug-in contact receptacles in the respective contact carrier are arranged offset in relation to one another outside the contact carrier formations.

Those plug-in contacts that are received in the contact carrier formations, i.e. in the pin contact carrier formations and socket contact carrier formations, are in this case excepted from the aforementioned offset arrangement on account of the small installation space in these regions. If on the other hand one wished to speak of an arrangement structure at all in the case of the aforementioned number of for example four, five or six contact pairs per contact carrier formation, a possible arrangement of these plug-in contacts may best be described as arranged in rows and columns running at right angles, i.e. at right angles to one another. This means that the center points of the adjacent plug-in contacts form rectangles, in particular squares. In the ground terminal region, this structure can however only be realized to a restricted extent in a number of possible structural forms due to the particular structural features of the ground plug-in contact receptacles, specifically the opening or the passage.

The ground plug-in contacts, i.e. the ground pin contacts and ground socket contacts, can finally form an intended exception within this structure, that is to say "diverge" from this pattern, i.e. represent an exception with respect to their arrangement. This serves the purpose of allowing for those special structural features of the corresponding plug-in contact/socket contact receptacle that exist as a result of said opening or said passage. Finally, for example depending on the structural form, the necessary stability can possibly be ensured by a somewhat increased distance of the ground pin contact receptacle from the edge of the pin contact carrier.

At least two pin contacts and at least two socket contacts may be arranged in each ground terminal region, one of these at least two pin contacts being said ground pin contact and one of the two socket contacts being said ground socket contact. Accordingly, in each ground terminal region there may be arranged at least one further contact pair that is not a ground contact pair, which therefore can be used for electrical current and energy transmission. This already represents an advantage of the invention over the prior art. Finally, there is consequently an increase in the number of contact pairs in comparison with an arrangement in which the ground terminal region is only used for connecting to ground.

In a preferred design, at least five contact pairs are arranged in each ground terminal region, one of these five contact pairs being the ground contact pair. Consequently, in this ground contact region at least four further contact pairs are therefore available for electrical energy and signal transmission. As a result, the aforementioned advantage increases correspondingly. The center points of these four contact pairs and their plug-in contact receptacles in the associated contact carrier can be arranged at right angles to one another. The ground contact pair however diverges from this pattern for the reasons mentioned above.

In the additional plug-in contact carrier region there may possibly be arranged for example six contact pairs, which serve exclusively for electrical energy and signal transmission. The center points of the adjacent plug-in contact receptacles of the additional plug-in contact carrier region may be arranged in relation to one another in the form of a rectangle, in particular a square.

Altogether, for example ten more contact pairs than is the case in the prior art can in this way be used, which represents a particular advantage.

It is of course advantageous for the electrical energy and signal transmission to arrange even more than four, five or six contact pairs intended for electrical current and/or signal transmission in the ground terminal region or in the additional plug-in contact carrier region, for example more than seven, eight, nine, ten, eleven or twelve or even more. There may also be precisely four, five, six, seven, eight, nine, ten, eleven or twelve or any other conceivable number of such contact pairs arranged in the ground terminal region or in the additional plug-in contact carrier region.

On the other hand there are of course also the structural conditions, in particular the minimum spacing of the contacts and the given overall dimensions of the plug-in connector and/or of the plug-in connector housing, so that the final structural form can be optimized for the respective application by weighing up these and further relevant, for example electrical parameters.

In the way described, a plug-in connector can be configured particularly compactly and, in a contact carrier installation space with a cross-sectional area of about 11-12 $cm^2$, comprise at least 56 plug-in contacts, preferably 57 plug-in contacts and particularly preferably 58 plug-in contacts and more. In addition, the installation space contains four flange regions, which are arranged in the respective corners and are in each case about 1 $cm^2$, so that the overall, rectangular installation space including the flanges is in this example approximately 3 cm*5 cm. This is mentioned by way of example for the best overall balance between the number of plug-in contacts and the available installation space.

Of course, other plug-in connector sizes with a comparable density of plug-in contacts, i.e. a number of plug-in contacts corresponding to the installation space, can also be realized in the same way. As mentioned at the beginning, the plug-in contacts may in this case each have for example a current-carrying capacity of at least 1 A, 2 A, 4 A, 6 A and/or 10 A and more. To increase the air gaps and the creepage paths, hollow-cylindrical formations and cylindrical depressions may in this case be alternately arranged on the pin contact carrier, on the plugging side at the continuous plug-in contact receptacles.

Of said 56 to 58 plug-in contacts of the aforementioned example, one or two plug-in contacts may for example be used as ground plug-in contacts, so that, by this structural form, for example 54, 55, 56, 57 or more contacts can be made available for electrical current and signal transmission in the installation space specified above with said current-carrying capacity. This is a considerable advantage over the prior art for a plug-in connector with such a convenient connection to ground.

The protective earthing element may be a stamped and bent part. The protective earthing element may be formed from sheet metal. Preferably, the protective earthing element may comprise a spring contact, in particular a contact lug. If the protective earthing element is for example arranged on the pin contact carrier formation, the spring element, in particular the contact lug, can reach through the opening thereof, in order to connect the protective earthing element in an electrically conducting manner to the received ground pin contact. If the protective earthing element is arranged on the socket contact carrier formation, it can reach with its spring element, in particular the contact lug, through the passage thereof, in order to connect the protective earthing element in an electrically conducting manner to the ground socket contact. In particular, the contact lug may comprise for this purpose a contact projection, for example a bossing, with which it at least partially reaches through the opening or the passage and by which it is in electrical contact with the respective plug-in contact.

The protective earthing element may have at least one angled-away flange with at least one screw openings, which serves being screwed on the at least partially metallic plug-in connector housing, and in particular being brought into electrical contact therewith for protective earthing.

As already mentioned, in a preferred design the at least partially metallic plug-in connector housing of the plug-in connector comprises the plug housing and the mating plug housing. The plug housing is in this case a component part of the plug and the mating plug housing is a component part of the mating plug. The pin contact carrier is received in the plug housing, or at least can be received therein, and the socket contact carrier is received in the mating plug housing, or at least can be received therein.

The plug housing and the mating plug housing may be in each case at least partially electrically conductive and for example consist of metal. They may be connected, or at least connectable, in an electrically conducting manner to the respective ground plug-in contact by way of the respective protective earthing element of the received pin contact carrier or socket contact carrier.

The protective earthing element may have at least one screw opening, which serves the purpose of screwing the inserted pin contact carrier in or on the plug housing, and also the inserted socket contact carrier in or on the mating plug housing, and thereby both mechanically fastening, and consequently electrically contacting, their respective at least one ground plug-in contact. In particular, the protective earthing element has two angled-away flanges, each with at least one such screw opening.

As already mentioned, in a preferred design the protective earthing element is a stamped and bent part, which is preferably made of metal, for example of sheet metal, in particular of spring steel, the protective earthing element having in particular a basic portion from which a contact spring, in particular a contact lug, is punched out. Preferably, laterally of the basic portion, two side parts are bent away at right angles therefrom, opposite one another in parallel. Furthermore, a locking means, in particular a locking window, may be arranged in each of the two side parts for locking engagement on a respective mating locking means, in particular a locking pin, of the contact carrier formations. Bent away at right angles from the ends of the side parts there is respectively a said flange with respectively a screw opening. These flanges serve for being screwed on the plug-in connector housing for fastening, and possibly also for protective earthing.

The basic portion may be slightly bent in in the region of its contact lug. For the electrical contacting with the respective ground plug-in contact, i.e. with the ground pin contact or the ground socket contact, the contact projection may be stamped in the contact lug.

BRIEF DESCRIPTION OF THE DRAWINGS

An exemplary embodiment of the invention is explained in more detail below and is shown in the drawings, in which.

DETAILED DESCRIPTION

The figures contain partially simplified, schematic representations. In some cases, identical reference signs are used for elements which are similar but may not be identical. Different views of the same elements may be drawn to different scales.

Figure 1A:
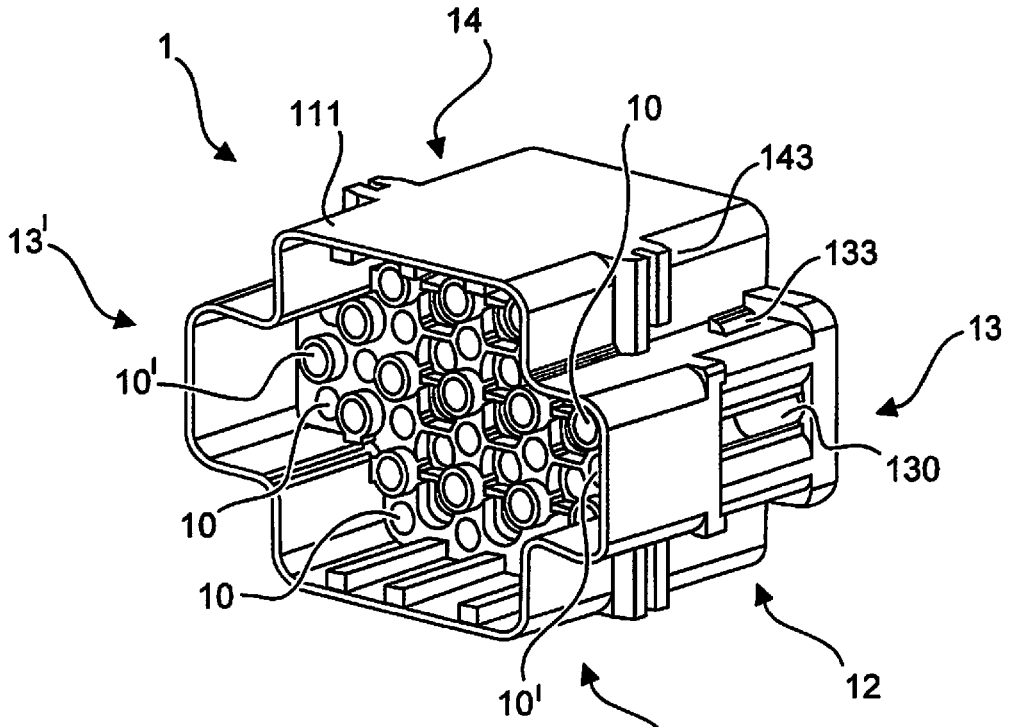
FIGS. 1*a, b* show a pin contact carrier, looking toward the plugging portion and the holding portion.
Figure 1B:
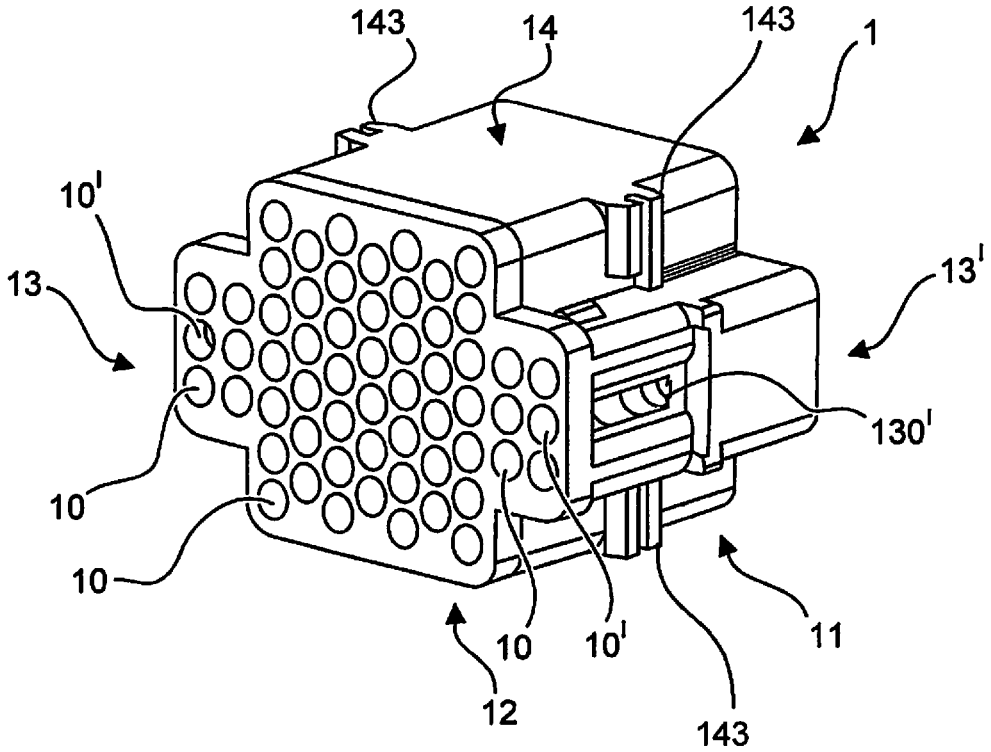

FIGS. 1*a, b* show a pin contact carrier 1. FIG. 1*a* shows the pin contact carrier 1, looking toward its plugging portion 11. FIG. 1*b* shows the pin contact carrier 1, looking toward its holding portion 12, which adjoins the plugging portion 11. The pin contact carrier 1 is of a symmetrical configuration.

The basic form of the pin contact carrier 1 is formed substantially by a basic cuboid 14, formed on both sides of which, symmetrically in relation to one another, are two substantially cuboidal pin contact carrier formations 13, 13', specifically a pin contact carrier formation 13 and a further pin contact carrier formation 13'. Part of the pin contact carrier formations 13, 13' respectively belongs to the plugging portion 11 and a further part of the pin contact carrier formations 13, 13' respectively belongs to the holding portion 12. The volume of each pin contact carrier formation 13, 13' is less than a quarter of the volume of the basic cuboid 14.

Figure 6:
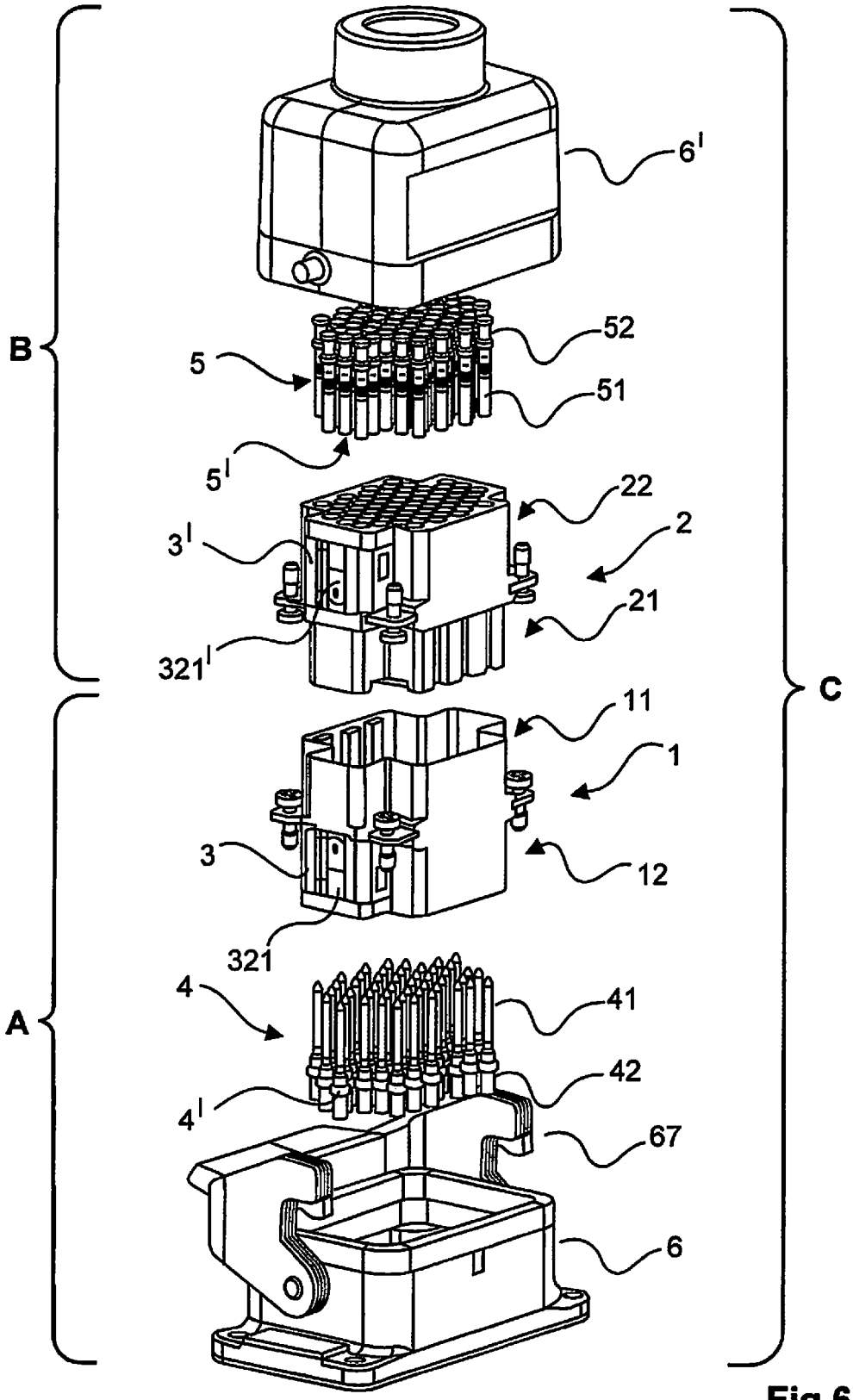
FIG. 6 shows a complete plug-in connector with a ground terminal region in an exploded representation.

The holding portion 12 comprises continuous pin contact receptacles 10, 10' for each receiving a terminal region 42 of a pin contact 4, which is represented in FIG. 6. In particular, the holding portion 12 comprises in each of its two pin contact carrier formations 13, 13' six continuous pin contact receptacles 10, 10', one of which in each case is configured as a ground pin contact receptacle 10'. Consequently, each pin contact carrier formation 13, 13' has in addition to said ground pin contact receptacle 10' five further pin contact receptacles 10, which are available for electrical current and/or signal transmission, only one of which in each case however is provided in the drawing with a reference sign by way of example. Both ground pin contact receptacles 10' are each distinguished by an opening 130, 130' through to an outer region of the respective pin contact carrier formation 13, 13'. Furthermore, the pin contact carrier 1 has lying opposite one another on each pin contact carrier formation 13, 13' a respective locking pin 133, only one of which in each case can be seen in the drawing because the other is concealed by the pin contact carrier formation 13, 13'. Furthermore, the pin contact carrier 1 has on each of both sides of its basic cuboid 14, in the region of the pin contact carrier formations 13, 13', two flange fastenings 143, which are intended together with the locking pin 133 for fastening a respective protective earthing element 3, 3'', the structural form of the protective earthing elements 3, 3' being shown in FIG. 3.

In the basic cuboid 14, the pin contact receptacles 10 are arranged offset in relation to one another, i.e. they form isosceles triangles with their nearest neighbors. In a cross-sectional area of approximately 3 cm*3 cm, it is in this way already possible to arrange forty-six pin contacts 4, which have in each case a current-carrying capacity of at least 10 A.

In the pin contact carrier formations 13, 13', the pin contact receptacles 10, 10' are arranged in rows and columns and form squares with their nearest neighbors. Therefore, altogether twelve of such pin contacts 4, 4' are to be arranged in these two regions. These two pin contacts 4, 4' are ground pin contacts 4'. Consequently, ten additional pin contacts 4 remain for electrical current and signal transmission. Altogether, therefore, 56 pin contacts are available on said limited installation space. Since this arrangement corresponds of course to the arrangement of the socket contacts 5, 5' in the socket contact carrier 2, this equally applies to the socket contacts 5, 5', without an explicit exposition of this being required.

In FIG. 1*a* it can also be seen well that, to increase the air gaps and creepage paths, hollow-cylindrical formations and cylindrical depressions are alternately arranged on the pin contact carrier 1, on the plugging side at continuous pin contact receptacles 10, 10'.

Figure 2A:
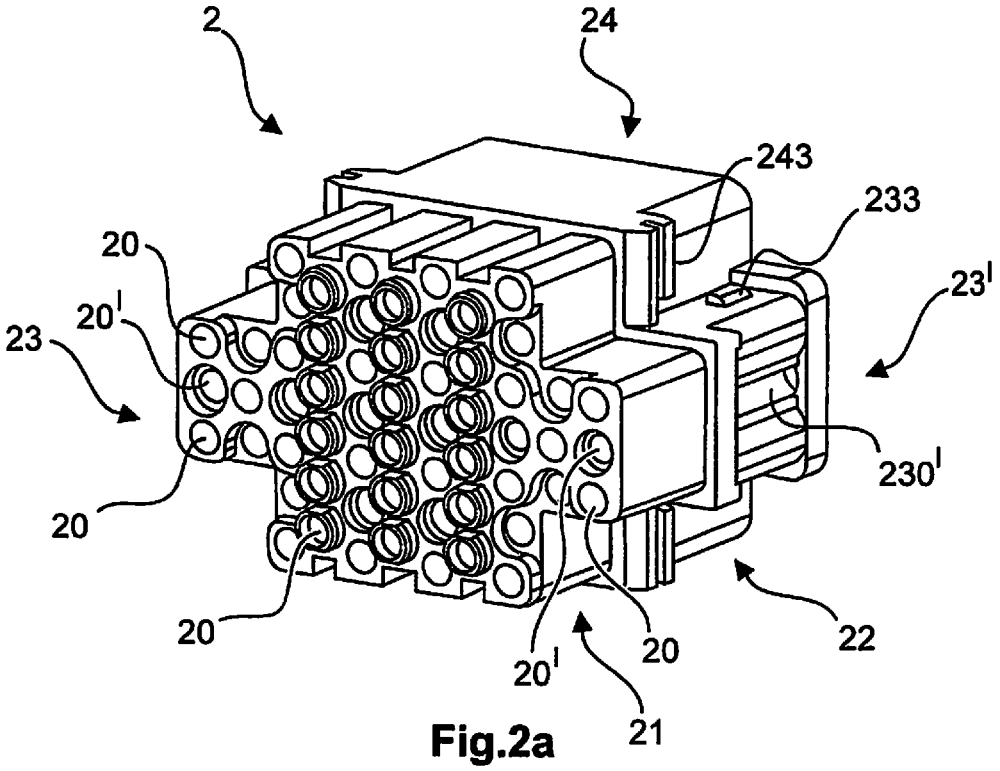
FIGS. 2*a, b* show a socket contact carrier, looking toward the mating plugging portion and the terminal portion.
Figure 2B:
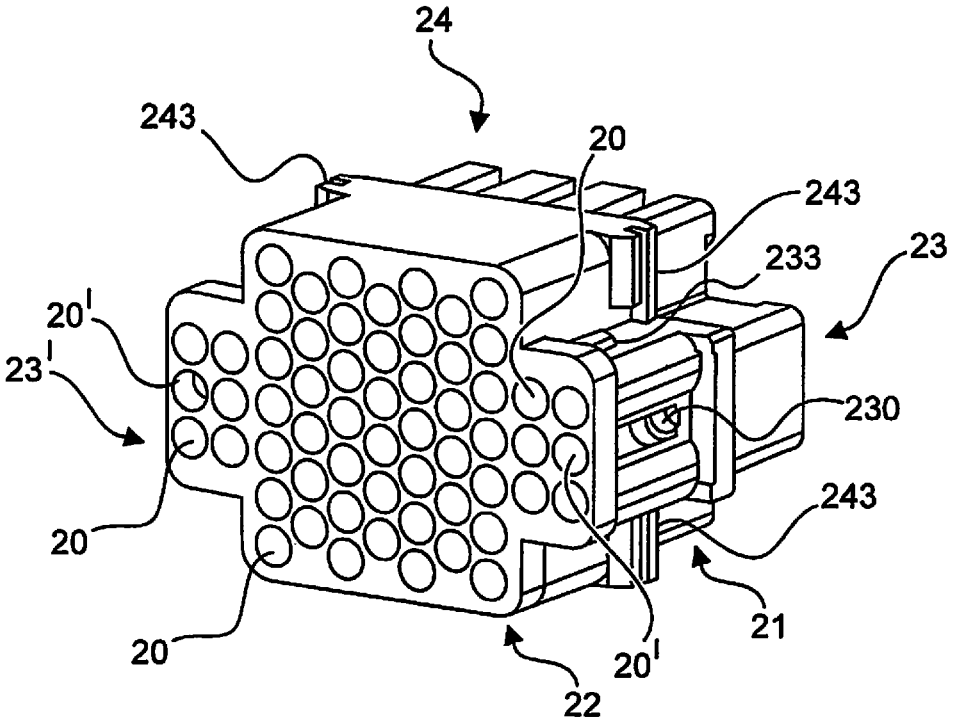

FIG. 2 shows a socket contact carrier 2. FIG. 2*a* shows the socket contact carrier 2, looking toward its mating plugging portion 21. FIG. 2*b* shows the socket contact carrier 2, looking toward its terminal portion 22, which adjoins the mating plugging portion 21.

The basic form of the socket contact carrier 2 is formed substantially by a basic cuboid 24, formed on both sides of which, symmetrically in relation to one another, are two substantially cuboidal socket contact carrier formations 23, 23', specifically a socket carrier formation 23 and a further socket carrier formation 23'. Part of the socket contact carrier formations 23, 23' respectively belongs here to the mating plugging portion 21. A further part of the socket contact carrier formations 23, 23' respectively belongs to the terminal portion 22.

The volume of each individual socket contact carrier formation 23, 23' is less than a quarter of the volume of the basic cuboid 24.

Figure 3A:
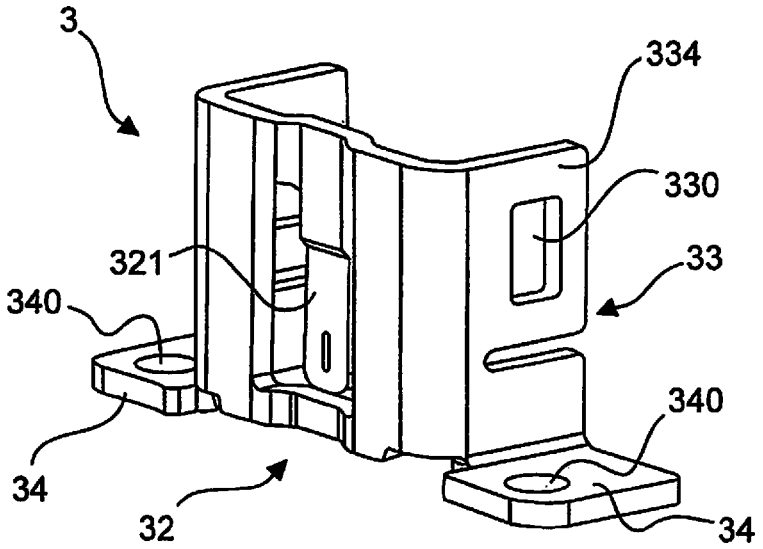
FIGS. 3*a, b* show a protective earthing element, looking toward an outer side and an inner side.
Figure 3B:
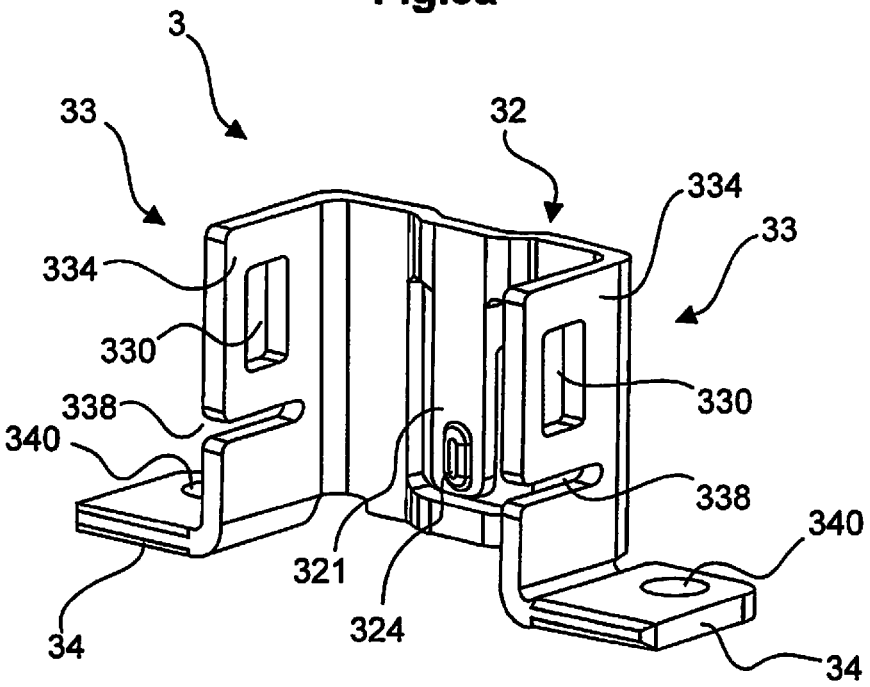

The socket contact carrier 2 comprises continuous socket contact receptacles 20, 20', running through the terminal portion 22 and the mating plugging portion 21, for each receiving a socket contact 5, 5'. The associated socket contacts 5, 5' are shown in FIG. 6. In particular, the socket contact carrier 2 comprises in each of the two socket contact carrier formations 23, 23' six continuous socket contact receptacles 20, 20', one of which is configured as a ground socket contact receptacle 20'. Consequently, each socket contact carrier formation 23, 23' has in addition to said ground socket contact receptacle 20' five further socket contact receptacles 20, which are available for electrical current and/or signal transmission, only one of which in each case however is provided in the drawing with a reference sign by way of example. Both ground socket contact receptacles 20' are each distinguished by a passage 230, 230' through to an outer region of the respective socket contact carrier formation 23, 23'. Furthermore, the socket contact carrier 2 has lying opposite one another on each socket contact carrier formation 23, 23' a respective locking pin 233, only one of which in each case can be seen in the drawing because the other is concealed by the socket contact carrier formation 23, 23'. Furthermore, the socket contact carrier 2 has on each of both sides of its basic cuboid 24, in the region of the socket contact carrier formations 23, 33', two flange fastenings 243, which are intended together with the locking pin 233 for fastening a respective protective earthing element 3', 3", the structural form of which is shown in FIG. 3.

In the basic cuboid 24, the socket contact receptacles 20 are arranged offset in relation to one another, i.e. they form isosceles triangles with their nearest neighbors.

In the socket contact carrier formations 23, the socket contact receptacles 20, 20' are arranged in rows and columns and thus form squares with their nearest neighbors.

In FIG. 2*a* it can also be seen that, to increase the air gaps and creepage paths, hollow-cylindrical formations and cylindrical depressions are alternately arranged on the plugging side at continuous socket contact receptacles 20, 20'.

FIG. 3 shows a first protective earthing element 3, the structural form of which also corresponds to the second protective earthing element 3', the third protective earthing element 3" and the fourth protective earthing element 3'".

The protective conductor element 3 is a stamped and bent part, which is formed from a spring-elastic sheet metal.

The protective earthing element 3 has a basic portion 32, from which a contact lug 321 is punched out in the middle. This contact lug 321 has a contact projection in the form of a bossing 324.

In the region of its contact lug 321, the basic portion 32 is slightly bent in.

Two side parts 33 are bent away from the basic portion 32 at right angles, opposite one another in parallel. Furthermore, a locking means, in particular a locking window 330, surrounded by a frame 334, may be arranged in each of the two side parts 33 for locking engagement on a respective mating locking means, specifically the locking pin 133, 233, of the respective contact carrier formation 13, 13', 23, 23'. In order to ensure the mobility of the frame 334, a slit 338 is arranged in each side part 33. Bent away at right angles from the ends of the side parts 33 there is a respective flange 34 with a respective screw opening 340.

Figure 4A:
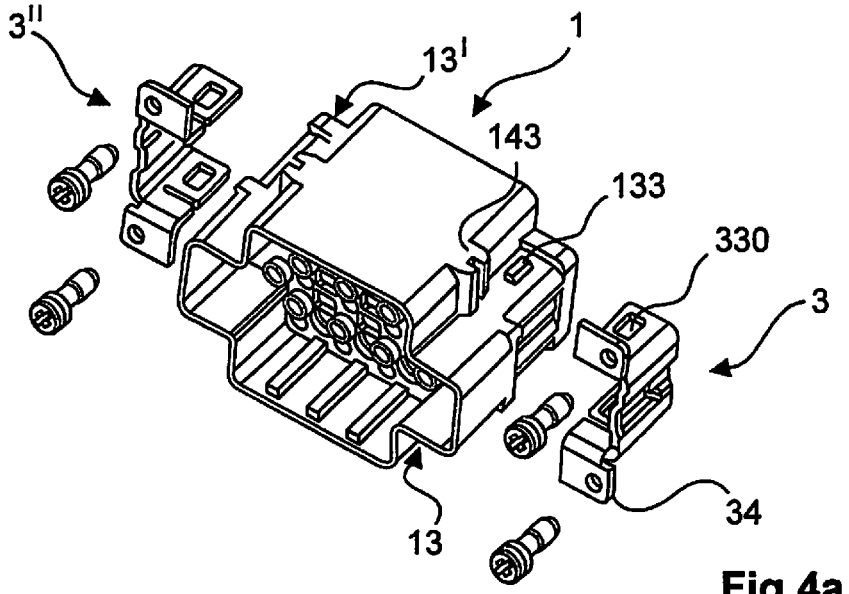
FIGS. 4*a-c* show the pin contact carrier with protective earthing elements to be fastened thereon and fastened thereon, from various views.
Figure 4B:
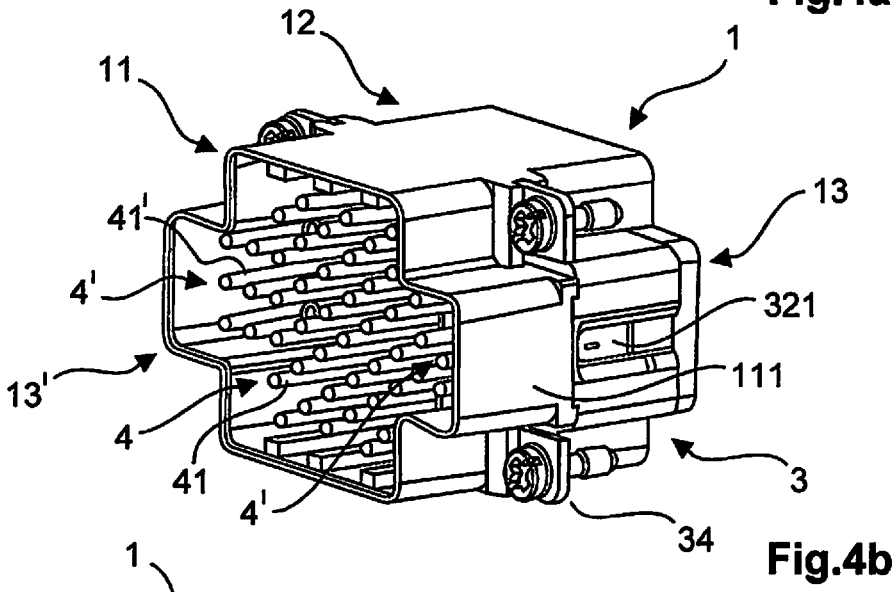
Figure 4C:
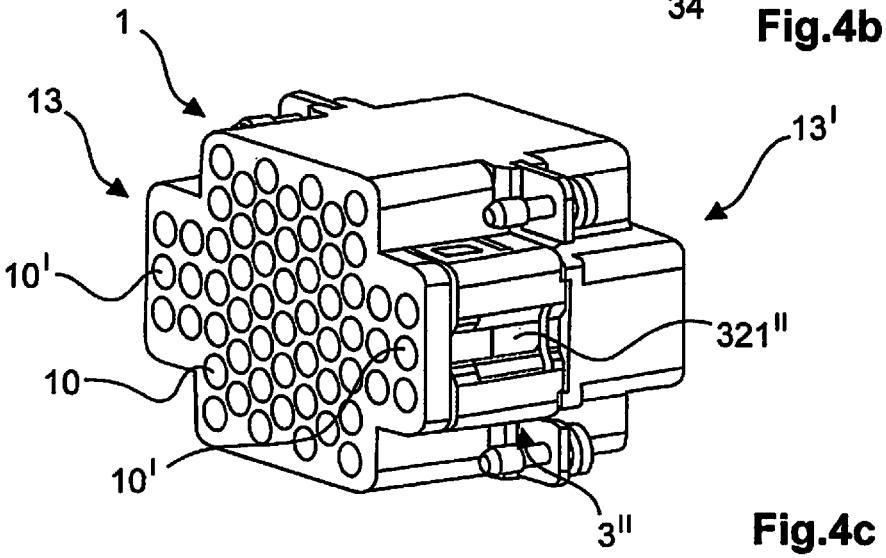

FIG. 4 shows the pin contact carrier 1 together with the first and third protective earthing elements 3, 3".

FIG. 4*a* shows the pin contact carrier 1 with these two protective earthing elements 3, 3" to be mounted on its pin contact carrier formations 13, 13'. It can be seen by way of example how, during assembly, the window 330 can engage on the locking pin 133 and how the flanges 34 can be received by the flange fastenings 143.

FIG. 4*b* shows the pin contact carrier 1 with the protective conductor elements 3, 3' attached thereto and the inserted pin contacts 4, 4'. As already mentioned, the pin contacts 4, 4' are held by their terminal region 42 in the pin contact receptacles 10,10' of the holding portion 12 and protrude with their exposed contact pins 41, 41' into the plugging portion 11 surrounded by the collar 111. In this case, the ground pin contacts 4' are held stably by their terminal regions 42', which cannot be seen in this representation, in the ground pin contact receptacles 10' of the pin contact carrier 1.

In this representation, the protective earthing elements 3, 3" have already been mounted on the pin contact carrier 1. The contact lugs 321, 321" of the protective conductor elements 3,3" reach through the respective opening 130, 130' and thus make electrical contact with the respective ground pin contacts 4', which are arranged in the ground pin contact receptacles 10'.

FIG. 5 shows the socket contact carrier 2 together with the second and fourth protective earthing elements 3', 3".

Figure 5A:
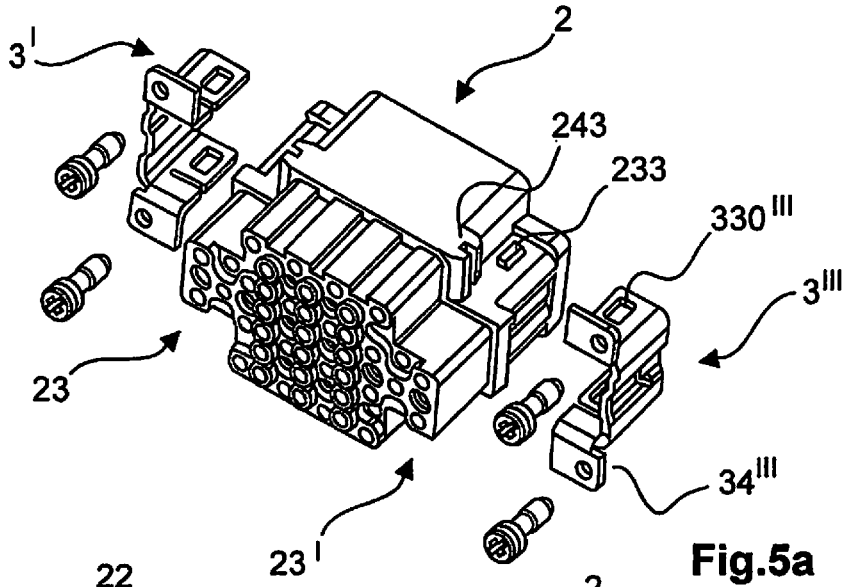
FIGS. 5*a-c* show the socket contact carrier with protective earthing elements to be fastened thereon and fastened thereon, from various views.

FIG. 5*a* shows the socket contact carrier 2 with the two protective earthing elements 3', 3'" to be mounted on its socket contact carrier formations 23, 23'. It can be seen by way of example how, during the assembly, the window 330'" can engage on the locking pin 233 and how the flanges 34'" can be received by the flange fastenings 143.

Figure 5B:
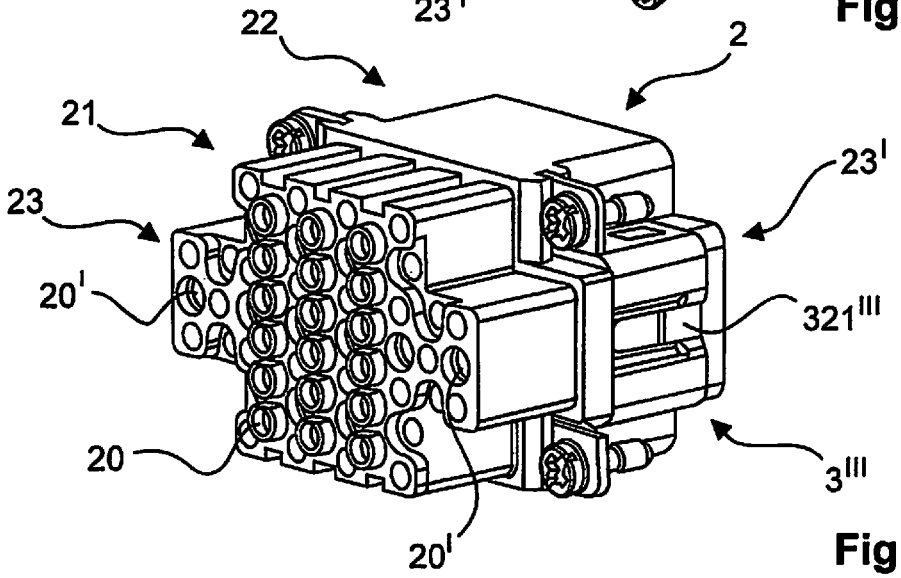
Figure 5C:
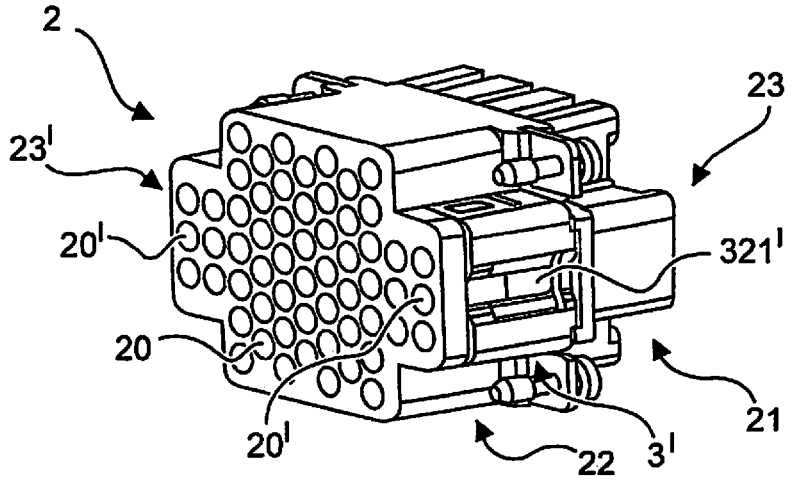

FIGS. 5*b* and 5*c* show the socket contact carrier 2 with the protective conductor elements 3', 3'" attached thereto and the inserted socket contacts 5, 5', which are not visible in the drawing at this point because they have been received completely in the socket contact receptacles 20, 20' of the socket contact carrier 2. The socket contacts 5, 5' each have a terminal region 52, which is arranged in the terminal portion 22 of the socket contact carrier 2. The socket contacts 5, 5' also have contact sockets 51 on the plugging side, which are arranged in the mating plugging portion 21.

In this representation, the protective earthing elements 3', 3'" have already been mounted on the socket contact carrier 2. The contact lugs 321', 321" of the protective conductor elements 3', 3'" reach through the respective passage 230, 230' and thus make electrical contact with the respective ground socket contacts 5', which are arranged in the ground socket contact receptacles 20'.

FIG. 6 shows a complete plug-in connector C, consisting of a plug A and a mating plug B, in an exploded representation.

The plug A, shown at the bottom of the drawing, has a metallic plug housing 6, into which the pin contact carrier 1 provided with the pin contacts 4,4' can be inserted and in which it can be fixed by screwing.

First, the pin contacts 4, 4' are crimped with electrical lines of a first cable, which is not shown in the drawing, at their respective terminal region 42, which is a crimping region. Then, the pin contacts 4, 4' are inserted with their contact pin 41 ahead into the pin contact receptacles 10, 10' of the holding portion 12 of the pin contact carrier 1, and thus fitted deep into the holding portion 12, until their terminal region 42 engages in the pin contact carrier 1 in a locking manner and, as already shown in FIG. 4*b*, their contact pins 41 project freely into the plugging portion 11.

In particular, the ground pin contacts 4' are in this way first crimped with a respective PE line of the first cable and fitted into the ground pin contact receptacles 10' of the holding region 12. As already mentioned, the first and third protective earthing elements 3, 3" make electrical contact by means of their contact lugs 321, 321" with the respective ground pin contact 4', and thus earth the plug housing 6 as soon as it is screwed in it.

The mating plug B, shown at the top of the drawing, has a metallic mating plug housing 6', into which the socket contact carrier 2 provided with the socket contacts 5, 5' can be inserted and in which it can be fixed by screwing.

For this purpose, the socket contacts 5, 5' are first crimped with electrical lines of a second cable, which is not shown in the drawing, at their respective terminal region 42, which is a crimping region. Then, the socket contacts 5, 5' are inserted with their contact socket 51 ahead into the socket contact receptacles 20, 20' of the terminal portion 22 of the socket contact carrier 2, until they have been completely received by the socket contact carrier 2 and are engaged therein in a locking manner. Then, their terminal regions 52 are arranged in the terminal portion 22 and their contact sockets 51 are arranged in the mating plugging portion 21 of the socket contact carrier 2.

In particular, the ground socket contacts 5' are in this way crimped with a respective PE line of the second cable and fitted into the ground socket receptacles 20' of the terminal region 12. As already mentioned, the second and fourth protective earthing elements 3, 3'" make electrical contact by means of their contact lugs 321', 321'" with the respective ground pin contact 4', and thus earth the plug housing 6 as soon as it is screwed in it.

Figure 7A:
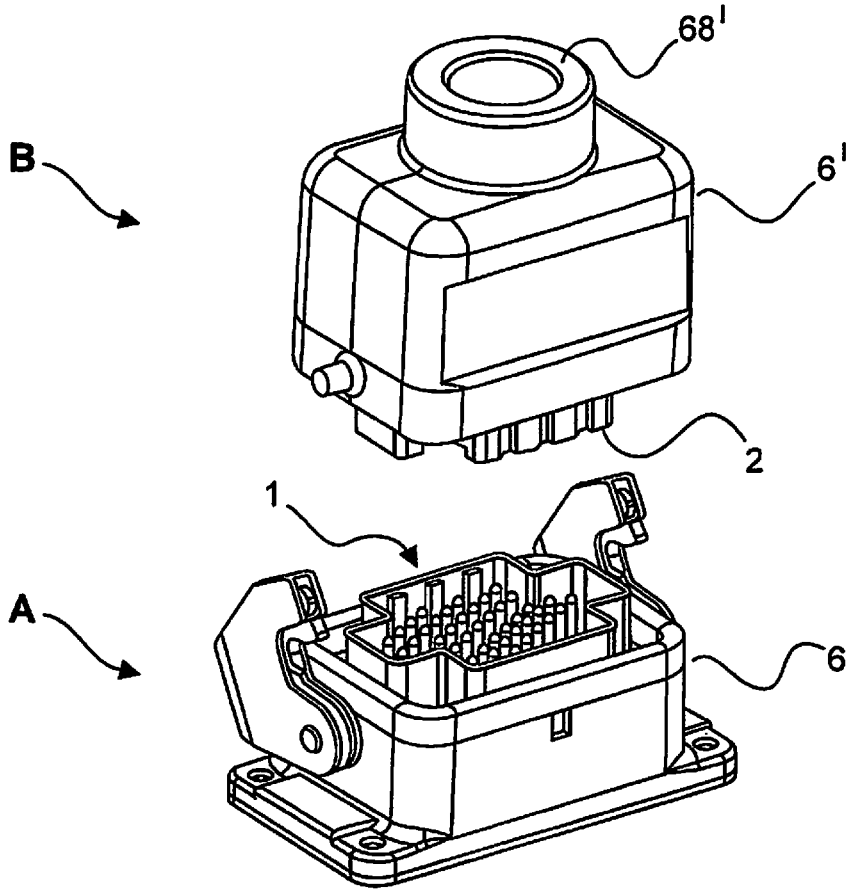
FIGS. 7*a, b* show the assembled plug-in connector in the unplugged state and in the plugged state.

FIGS. 7*a, b* show the assembled plug A and the assembled mating plug B in the unplugged state and in the plugged state.

For reasons of overall clarity, the two cables are not shown in the drawing. However, the screwed cable gland 68' of the mating plug housing, through which the second cable is to be led and on which it is to be fastened, is shown.

In FIG. 7*a*, it can be seen how the pin contact carrier 1 is received in the plug housing 6. It is in this case screwed by means of its protective earthing elements 3, 3" screwed in the plug housing. The socket contact carrier 2 is similarly screwed by means of its protective earthing elements 3', 3'" in the mating plug housing 6'. As a result, the plug housing 6 and the mating plug housing 6' are earthed and the contact carriers 1, 2 are held stably therein.

Figure 7B:
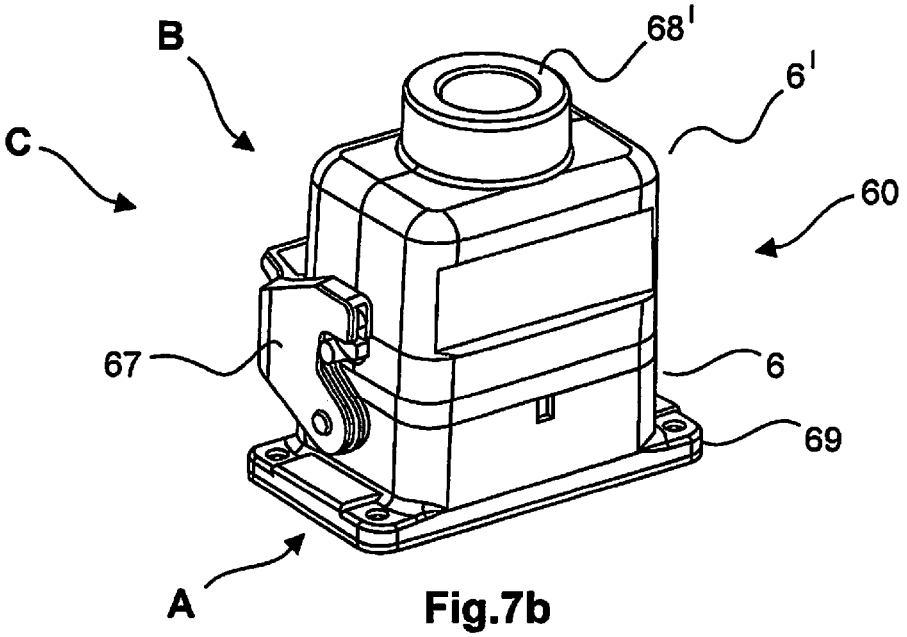

In FIG. 7*b*, the plug A and the mating plug B are plugged together. Their housings 6, 6' are thereby locked together by a locking clamp 67 of the plug housing 6 and together form the plug-in connector housing 60. In this state, the ground contact pairs, consisting of the ground pin contacts 4' and the ground socket contacts 5', are plugged together, and as a result also provide a particularly stable and reliable connection to ground on the plugging side. The plug housing 6 has a housing flange 69, and as a result can for example be screwed onto an equipment housing. Consequently, the ground potential of the equipment housing can also be electrically connected to the plug-in connector housing 60, and as a result also to said PE lines.

Figure 8A:
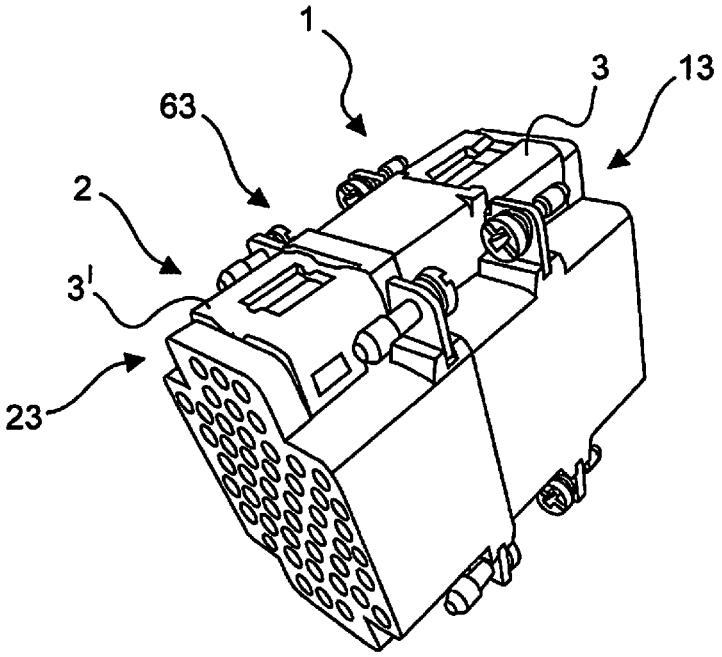
FIGS. 8*a, b* show the two contact carriers plugged together, looking toward a ground terminal region in a partially transparent representation.
Figure 8B:
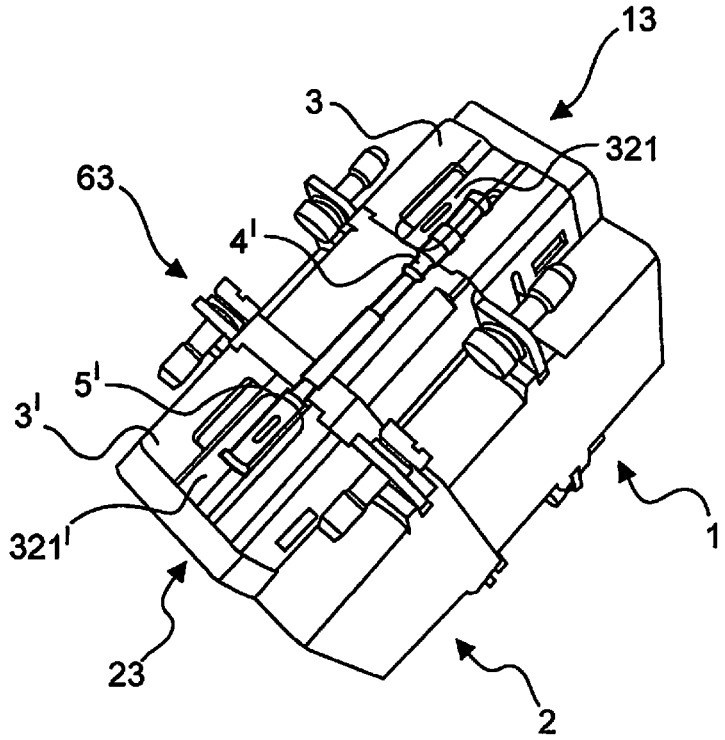

FIGS. 8*a* and 8*b* show the two plugged-together contact carriers 1, 2, specifically the pin contact carrier 1 and the socket contact carrier 2. Their contact carrier formations 13, 23, specifically the pin contact carrier formation 13 and the socket contact carrier formation 23, together form the ground terminal region 63. On the opposite side, which in this representation is concealed by the two contact carriers 1, 2 and is therefore not visible, the plug-in connector C also has in this structural form a further ground terminal region, which is not provided with a reference sign and is formed by the two other contact carrier formations 13', 23', which are not visible in this representation.

In FIG. 8*b*, the contact carriers 1, 2 are shown as partially transparent, so that it is possible to see the ground plug-in contacts 4', 5' received in the ground terminal region 63. The ground pin contact 4' is brought into electrical contact by the contact lug 321 of the first protective conductor element 3. For this purpose, this contact lug 321 reaches through the opening 130 in the pin contact carrier 1. The ground socket contact 5' is brought into electrical contact by the contact lug 321' of the second protective conductor element 3'. For this purpose, this contact lug 321' reaches through the passage 230 in the socket contact carrier 2.

It can also be seen how the ground pin contact 4' is plugged together with the ground socket contact 5', with which it forms a ground contact pair, i.e. its contact pin 41' has been at least partially received by the contact socket 51' of the socket contact 5'. Consequently, a particularly reliable and stable, pluggable, electrically conducting connection to ground is also established by way of the ground plug-in contacts 4', 5'.

Even though various aspects or features of the invention are respectively shown in combination in the figures, it is clear to a person skilled in the art that—unless otherwise stated—the combinations shown and discussed are not the only ones possible. In particular, mutually corresponding units or complexes of features from different exemplary embodiments can be exchanged with one another.

The words "example" and "exemplary" as used herein mean serving as an instance or illustration. Any embodiment or design described herein as "example" or "exemplary" is not necessarily to be construed as preferred or advantageous over other embodiments or designs. Rather, use of the word example or exemplary is intended to present concepts in a concrete fashion. As used in this application, the term "or" is intended to mean an inclusive "or" rather than an exclusive "or". That is, "A or B" refers to any of "A alone," "B alone," and "both A and B" unless specified otherwise or clear from context. The articles "a" and "an" as used in this application should generally be construed to mean "one or more" unless specified otherwise or clear from context to be directed to a singular form.

LIST OF REFERENCE SIGNS

1 Pin contact carrier
10 Pin contact receptacles
10' Ground pin contact receptacles
11 Plugging portion
111 Collar
12 Holding portion
13 Pin contact carrier formation
13' Further pin contact carrier formation
130, 130' Opening
133 Locking pin of the pin contact carrier
14 Basic cuboid
143 Flange fastenings of the pin contact carrier

2 Socket contact carrier
20 Socket contact receptacles
20' Ground socket contact receptacles
21 Mating plugging portion
22 Terminal portion
23 Socket contact carrier formation
23' Further socket contact carrier formation
230, 230' Passage
233 Locking pin of the socket contact carrier
24 Basic cuboid
243 Flange fastenings of the socket contact carrier
3, 3', 3", 3" First, second, third and fourth protective earthing elements
32 Basic portion
321, 321', 321", 321'" Contact lugs of the first, second, third and fourth protective earthing elements
324 Contact projection, bossing
33 Side parts
330, 330'" Fastening elements, locking window
334 Frame
338 Slit
34, 34'" Flanges
340 Screw opening
4 Pin contact
4' Ground pin contact
41 Contact pin
42 Terminal region of the pin contact
5 Socket contact
51 Contact socket
52 Terminal region of the socket contact
6 Plug housing
6' Mating plug housing
60 Plug-in connector housing
63 Ground terminal region
67 Locking clamp
68 Screwed cable gland
69 Housing flange
A Plug
B Mating plug
C Plug-in connector

The invention claimed is:

1. A plug, comprising:
a contact carrier (1, 2), the contact carrier (1, 2), comprising
a plurality of receptacles (10, 10') configured to receive pin contacts (4) or socket contacts (5),
an opening (130) extending through the contact carrier (1, 2) into a first of the plurality of receptacles (10') on a first side of the contact carrier (1, 2), and
two locking pins (133),
a first of the two locking pins (133) being arranged above the opening (130), and
a second of the two locking pins (133) being arranged below the opening (130); and
a protective earthing element (3) arranged on the first side of the contact carrier,
the protective earthing element (3) having
a contact lug (321) which extends through the opening (130) into the first of the plurality of receptacles (10') and
two locking windows (330) arranged on opposite sides of the contact lug (321),
wherein the first of the two locking pins (133) engages a first of the two locking windows (330), and
wherein the second of the two locking pins (133) engages a second of the two locking windows (330).

2. The plug as in claim 1, wherein the protective earthing element comprises:
a basic portion (32) having a middle from which the contact lug (321) extends; and
two side parts (33) that are bent away from the basic portion (32) at right angles, the two side parts (33) being arranged opposite one another in parallel, one of the two locking windows (330) being arranged in each of the two side parts (33).

3. The plug as in claim 2,
wherein each of the two side parts (33) has an end from which a flange (34) is bent away at a right angle, the flanges (34) of the two side parts (33) being arranged in a common plane.

4. The plug as in claim 3,
wherein the flanges (34) are received in flange fastenings (143) formed on the contact carrier (1, 2).

5. The plug as in claim 4,
wherein each of the two side parts (33) comprises a slit (338) between the respective locking window (330) and the respective flange (34), and
wherein each respective flange (34) comprises a screw opening (340).

6. The plug as in claim 5,
further comprising a metallic plug housing (6),
wherein the contact carrier (1, 2) is fixed in the metallic plug housing (6) by screws extending through the screw openings (340) of the flanges (34).

7. The plug as in claim 1,
wherein hollow-cylindrical formations and cylindrical depressions are alternately arranged on the contact carrier at ends of the receptacles (10, 10'), thereby increasing creepage paths between adjacent pin contacts (4).

8. The plug as in claim 1, wherein the contact carrier (1, 2) comprises
a central basic cuboid from which
lateral cuboidal contact carrier formations extend on opposite sides, each of the lateral cuboidal contact carrier formations being smaller than the central basic cuboid.

9. The plug as in claim 8,
wherein the two locking pins (133) are arranged on the lateral cuboidal contact carrier formations.

10. A plug-in connector (C), comprising:
a plug (A) having
a pin contact carrier (1), the pin contact carrier (1), comprising
a plurality of pin contact receptacles (10, 10') configured to receive pin contacts (4, 4'),
a first opening extending through the pin contact carrier (1) into a first of the plurality of pin contact receptacles (10') on a first side of the pin contact carrier (1), and
two first locking pins (133),
a first of the two first locking pins (133) being arranged above the first opening (130), and
a second of the two first locking pins (133) being arranged below the first opening (130); and
a first protective earthing element arranged on the first side of the pin
contact carrier, the first protective earthing element having
a first contact lug (321) which extends through the first opening into the first of the plurality of pin contact receptacles (10'), and two first locking windows (330) arranged on opposite sides of the first contact lug (321), wherein the first of the two first locking pins (133) engages a first of the two first locking windows (330), and wherein the second of the two first locking pins (133) engages a second of the two first locking windows (330); and a mating plug (B) having a socket contact carrier (2), the socket contact carrier (2), comprising a plurality of socket contact receptacles (20, 20') configured to receive socket contacts (5, 5'), a second opening extending through the socket contact carrier (2) into a first of the plurality of socket contact receptacles (20') on a first side of the socket contact carrier (2), and two second locking pins (133), a first of the two second locking pins (133) being arranged above the second opening (130), and a second of the two second locking pins (133) being arranged below the second opening (130);

a second protective earthing element arranged on the first side of the socket contact carrier, the second protective earthing element having a second contact lug (321) which extends through the second opening into the first of the plurality of socket contact receptacles (20'), and two second locking windows (330) arranged on opposite sides of the second contact lug (321), wherein the first of the two second locking pins (133) engages a first of the two second locking windows (330), and wherein the second of the two second locking pins (133) engages a second of the two second locking windows (330).

11. The plug-in connector (C) as in claim 10, wherein the first protective earthing element and the second protective earthing element are identical.

12. A plug, comprising:

a contact carrier (1, 2), the contact carrier (1, 2), comprising a plurality of receptacles (10, 10') configured to receive pin contacts (4) or socket contacts (5), an opening (130) extending through the contact carrier (1, 2) into a first of the plurality of receptacles (10') on a first side of the contact carrier (1, 2); and a protective earthing element (3) arranged on the first side of the contact carrier, the protective earthing element (3) having a basic portion (32) having a middle from which a contact lug (321) extends; and two side parts (33) that are bent away from the basic portion (32) at right angles, the two side parts (33) being arranged opposite one another in parallel, wherein the contact lug (321) extends through the opening (130) into the first of the plurality of receptacles (10'), wherein the contact carrier (1, 2) comprises two locking pins (133), a first of the two locking pins (133) being arranged above the opening (130), and a second of the two locking pins (133) being arranged below the opening (130), wherein each of the two side parts (33) includes a locking window, wherein the first of the two locking pins (133) engages a first of the two locking windows (330), and wherein the second of the two locking pins (133) engages a second of the two locking windows (330), and wherein each of the two side parts (33) has an end from which a flange (34) is bent away at a right angle, the flanges (34) of the two side parts (33) being arranged in a common plane.

* * * * *